US009701007B2

(12) United States Patent
Holubarsch et al.

(10) Patent No.: US 9,701,007 B2
(45) Date of Patent: Jul. 11, 2017

(54) SIDE HANDLE

(71) Applicant: Hilti Aktiengesellschaft, Schaan (LI)

(72) Inventors: Markus Holubarsch, Karlsruhe (DE); Stefan Schmid, Untermuehlhausen (DE); Stefan Hammerstingl, Munich (DE); Ferdinand Kirsten, Gilching (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 14/891,305

(22) PCT Filed: May 14, 2014

(86) PCT No.: PCT/EP2014/059812
§ 371 (c)(1),
(2) Date: Nov. 13, 2015

(87) PCT Pub. No.: WO2014/184222
PCT Pub. Date: Nov. 20, 2014

(65) Prior Publication Data

US 2016/0114472 A1 Apr. 28, 2016

(30) Foreign Application Priority Data

May 16, 2013 (EP) ..... 13168118

(51) Int. Cl.
*B25F 5/02* (2006.01)

(52) U.S. Cl.
CPC ..... *B25F 5/026* (2013.01); *B25F 5/02* (2013.01); *Y10T 16/4713* (2015.01)

(58) Field of Classification Search
CPC . B25F 5/026; B25F 5/02; B25D 17/04; Y10T 16/4713; Y10T 16/4559; Y10T 16/469; B25G 1/04
(Continued)

(56) References Cited

U.S. PATENT DOCUMENTS 4,276,675 A * 7/1981 Pioch ..... B23B 45/001 16/426
5,049,012 A * 9/1991 Cavedo ..... B25F 5/026 16/426
(Continued)

FOREIGN PATENT DOCUMENTS

DE 102009000598 8/2009
EP 1974867 10/2008
(Continued)

*Primary Examiner* — William Miller
(74) *Attorney, Agent, or Firm* — Davidson, Davidson & Kappel, LLC

(57) ABSTRACT

A side handle (18) is provided for a handheld power tool (1). The user can grasp the side handle (18) by a grip element (19). A ring-shaped clamp is provided for clamping the side handle (18) onto the handheld power tool (1). The clamp (36) has two ends (32, 33) that can be joined. A pre-tensioned spring (39) presses the joinable ends (32, 33) against a stop (40) in order to join them under a force that acts in an effective direction (29). A release mechanism (41, 43) is held in a normal position by the force of the pre-tensioned spring (29) that acts in the effective direction (29). Against the force of the pre-tensioned spring (39) that acts in the effective direction (29), the user can deflect the release mechanism (41) into a release position in order to cancel the force that presses the joinable ends against the stop.

8 Claims, 4 Drawing Sheets

(58) Field of Classification Search
USPC ..... 16/426, 406, 422; 81/489, 177.2; 173/170; 294/58
See application file for complete search history.

(56) References Cited

U.S. PATENT DOCUMENTS 7,823,256 B2 * 11/2010 Engelfried ..... B25D 17/04 16/426
8,032,990 B2 * 10/2011 Shinma ..... B25D 17/04 16/426
8,122,569 B2 * 2/2012 Paul ..... B25F 5/026 16/422
8,166,614 B2 * 5/2012 Martin ..... B25F 5/026 16/422
8,186,018 B2 * 5/2012 Martin ..... B25F 5/026 16/422
8,621,719 B2 * 1/2014 Nakashima ..... B25F 5/026 16/422
2004/0163214 A1 8/2004 Cheng
2009/0178520 A1 * 7/2009 Engelfried ..... B25D 17/04 81/489
2009/0307875 A1 * 12/2009 Nakashima ..... B25F 5/026 16/436
2010/0064480 A1 * 3/2010 Martin ..... B25F 5/026 16/426
2010/0064482 A1 3/2010 Martin
2011/0011609 A1 * 1/2011 Simm ..... B25D 17/04 173/171
2015/0174753 A1 * 6/2015 Kamiya ..... B25F 5/008 173/170

FOREIGN PATENT DOCUMENTS

GB 200722762/2444156 5/2008
WO WO2009/137808 11/2009

* cited by examiner

SIDE HANDLE

The present invention relates to a side handle for a handheld power tool.

BACKGROUND

British patent specification GB 200722762 A discloses a side handle. The side handle has a hoop-shaped grip and a ring-shaped clamp that can be fastened, for example, to the neck of a power drill. A bayonet coupling clamps the open ends of the clamp between the legs of the grip in order to tension the clamp. In order to tighten and loosen the clamp, the user needs one hand to hold the grip and the other hand to open or close the closure mechanism.

SUMMARY OF THE INVENTION

The present invention provides a side handle for a handheld power tool, especially a chiseling handheld power tool. The user can grasp the side handle by the grip element. A ring-shaped clamp is provided for clamping the side handle onto the handheld power tool. The clamp has two ends that can be joined. A pre-tensioned spring presses the joinable ends against a stop in order to join them under a force that acts in an effective direction. A release mechanism is held in a normal position by the force of the pre-tensioned spring that acts in the effective direction. Against the force of the pre-tensioned spring that acts in the effective direction, the user can deflect the release mechanism into a release position in order to cancel the force that presses the joinable ends against the stop.

The side handle can be attached to or detached from the handheld power tool with one hand. The user only exerts a force to detach the side handle, whereas the pre-tensioned spring attaches it. The spring defines the normal position in which the two ends are joined together, thus tightening the ring-shaped clamp. The spring reaches its lowest pre-tension in that the clamp is tightened. The release is effectuated by uncoupling the spring from one side of the ends. For this purpose, however, the spring is not relaxed but rather, it is tensioned further against its pre-tension. The tension of the pre-tensioned spring is greater in the release position of the release mechanism than the pre-tension of the pre-tensioned spring in the normal position of the release mechanism.

One embodiment provides that a first end of the pre-tensioned spring is placed immovably in the side handle, while a second end of the pre-tensioned spring is movable, and the second end is coupled to the clamp and to the release mechanism. The movable end of the spring exerts a load on the clamp in the effective direction and the movable end of the spring likewise exerts a load on the release mechanism. When the release mechanism is shifted from the normal position into the release position, the part of the release mechanism that is coupled to the moveable end of the spring is deflected opposite to the effective direction.

One embodiment provides that the ends of the ring-shaped clamp rest on one side of the stop, and the unmovable first end of the pre-tensioned spring rests against the side of the stop that faces away from the one side. The pre-tensioned spring directly or indirectly exerts a force onto the clamp only in the effective direction. The stop uncouples the clamp from a force of the spring opposite to the effective direction. In particular, the stop is unmovable with respect to the grip section.

One embodiment provides that the ends of the clamp are slipped onto the tie rod in the radial direction and that they are arranged along the effective direction between the first end section of the tie rod and the stop. The user can advantageously place the clamp onto the handheld power tool without the grip section and can then clamp it between the tie rod and the spring only in order to lock it in place.

One embodiment provides that the tie rod has a non-circular cross section with a larger radial dimension and a smaller radial dimension. The ends of the clamp have a cylindrical cavity with an inner diameter that is equal to the larger radial dimension as well as a slot that radially opens up the cavity and whose width is equal to the smaller radial dimension. In order to remove the clamp, it has to be pivoted into its proper orientation relative to the tie rod.

One embodiment has a tie rod. The tie rod can be moved parallel to the effective direction relative to the stop and to the ends of the clamp. In the normal position, a first end section of the tie rod is non-positively coupled to the ends in the effective direction. The pre-tensioned spring is clamped between the stop and a second end section of the tie rod, and the tie rod exerts a force onto the tie rod in the effective direction. In the release position, the first end section of the tie rod is deflected against the force of the spring opposite to the effective direction. The non-positive coupling of the tie rod to the ends is cancelled.

One embodiment provides that the release mechanism comprises a toggle. One lever arm of the toggle can be permanently coupled to the tie rod or else it can be coupled non-positively to the tie rod opposite to the effective direction or else to the spring.

BRIEF DESCRIPTION OF THE DRAWINGS

The description below explains the invention on the basis of embodiments and figures by way of examples. The figures show the following.

Figure 1:
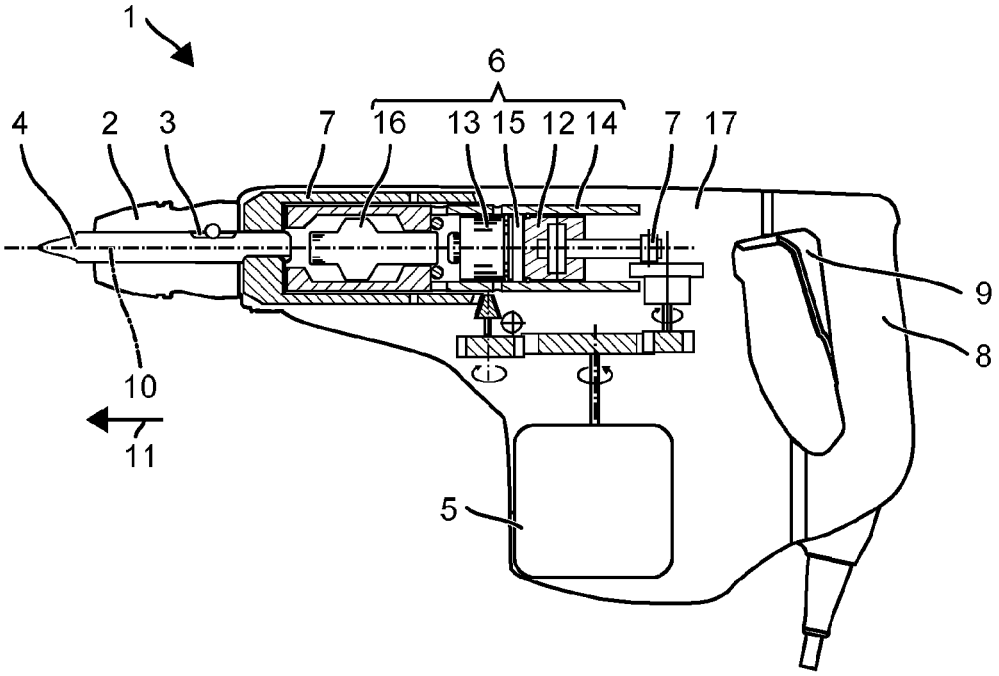
FIG. 1: a hammer drill.

Unless otherwise indicated, identical or functionally equivalent elements are designated in the figures with the same reference numerals. The description makes use of the expressions "left-hand" and "right-hand" on the basis of the depiction in the figures in order to indicate the relative orientation along an axis. Unless otherwise explicitly indicated, generally left-hand elements are offset relative to the corresponding right-hand elements in any given direction but in the same direction for all elements.

DETAILED DESCRIPTION

FIG. 1 shows a hammer drill 1 schematically as an example of a chiseling handheld power tool. The hammer drill 1 has a tool socket 2 into which one shank end 3 of a tool, for instance, a drill bit 4, can be inserted. A motor 5 that constitutes the primary drive of the hammer drill 1 serves to drive a striking mechanism 6 and a driven shaft 7. A user can hold the hammer drill 1 by means of a handle 8 and can start the operation of the hammer drill 1 by means of a system switch 9. During operation, the hammer drill 1 rotates the drill bit 4 continuously around a working axis 10 and, in this process, it can drive the drill bit 4 into a substrate in the impact direction 11 along the working axis 10.

The striking mechanism 6 is, for example, a pneumatic striking mechanism 6. An exciter 12 and a striker 13 are movably installed along the working axis 10 in a guide tube 14 of the striking mechanism 6. The exciter 12 is coupled to the motor 8 via an eccentric cam 7 or a toggle element and it is forced to execute a periodic, linear movement. An air cushion created by a pneumatic chamber 15 between the exciter 12 and the striker 13 couples a movement of the striker 13 to the movement of the exciter 12. The striker 13 can strike a rear end of the drill bit 4 either directly or else indirectly via an essentially stationary intermediate striker 16 and it can transfer part of its pulse to the drill bit 4. The striking mechanism 6 and preferably the additional drive components are arranged inside a power tool housing 17.

Figure 2:
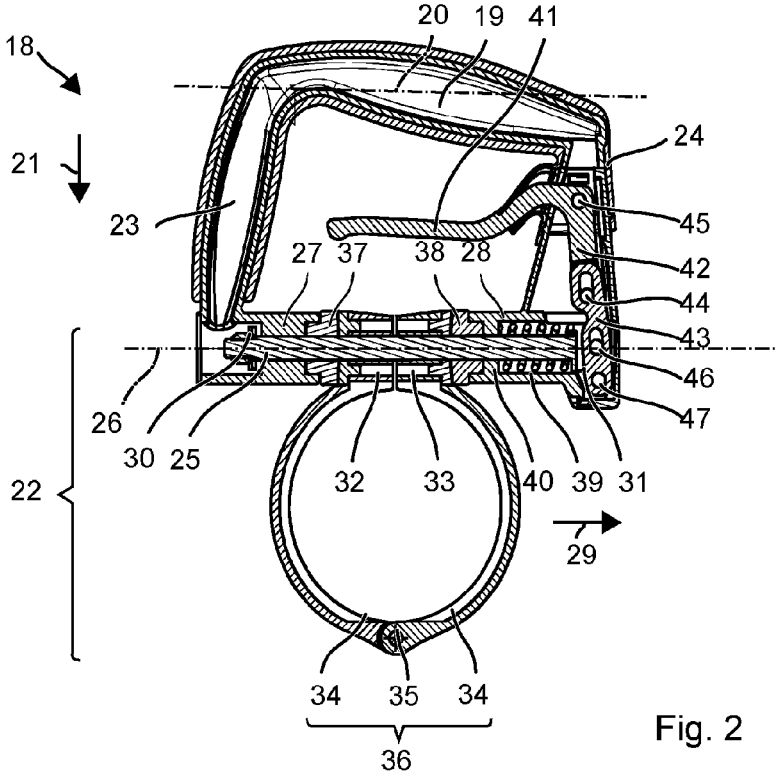
FIG. 2: a side handle in the normal position.
Figure 3:
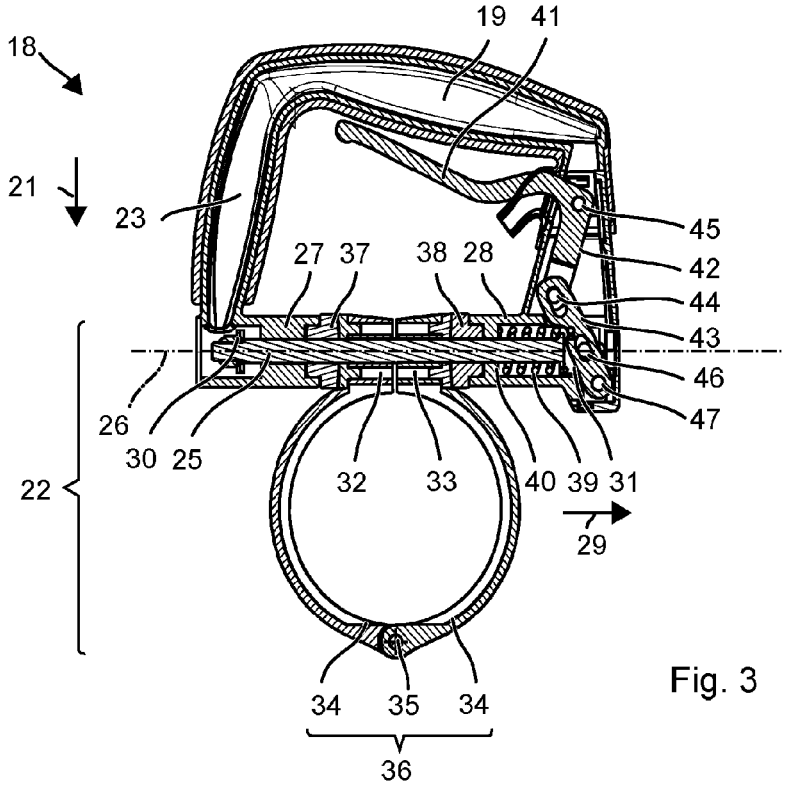
FIG. 3: the side handle in the release position.

FIG. 2 shows the side handle 18 in its normal position while FIG. 3 shows the side handle 18 in its release position.

The user can grasp the side handle 18 by its grip element 19 with one hand. The grip element 19 is essentially coaxial to a gripping axis 20. The gripping surface of the grip element 19 can be shaped to deviate from a right angle so as to be ergonomically adapted to the contour of a hand. In an extension of his/her hand and lower arm, the user introduces a holding force perpendicular to the grip axis 20 along a holding direction 21. Arranged opposite from the grip element 19 in the holding direction 21, there is a fastening section 22 with which the side handle 18 can be fastened to the handheld power tool 1, as needed. The hoop-shaped configuration reduces torques acting upon the grip element 19 and upon the hand when the handheld power tool is being held by the side handle 18. Two legs 23, 24 that are opposite from each other and oriented along the holding direction 21 join the grip element 19 and the fastening section 22 to form a closed frame.

The fastening section 22 has a tie rod 25 whose axis 26 can be parallel to the grip axis 20. The tie rod 25 is movably suspended in a first (left-hand) pillow block bearing 27 and in a second (right-hand) pillow block bearing 28 along its axis 26. The direction along the axis 26 from the left-hand pillow block bearing 27 to the right-hand pillow block bearing 28 is designated below as the pulling direction 29.

Each pillow block bearing 27, 28 is rigidly attached to one of the legs 23, 24. The two ends of the pillow block bearings 27, 28 facing each other are not connected and can be moved relative to each other. The grip elements 19 and the legs 23, 24 have sufficient elasticity to be able to increase the distance between the pillow block bearings 27, 28 along the axis 26 by several millimeters.

On its first (left-hand) end, the tie rod 25 has an anchor 30 that projects radially relative to the axis 26. A surface of the left-hand pillow block bearing 27 facing opposite from the pulling direction 29 forms a stop for the anchor 30. As soon as the anchor 30 is in contact with the left-hand pillow block bearing 27, the tie rod 25 can only be moved in the pulling direction 29 if it carries along the left-hand pillow block bearing 27. In the embodiment given by way of an example, the tie rod 25 protrudes beyond the left-hand pillow block bearing 28 opposite from the pulling direction 29. The inner diameter of the left-hand pillow block bearing 27 is adapted to the cross section of the tie rod 25 and it is smaller than the radial dimension of the anchor 30.

The tie rod 25 has a radially projecting disk 31 on its second (right-hand) end.

Figure 4:
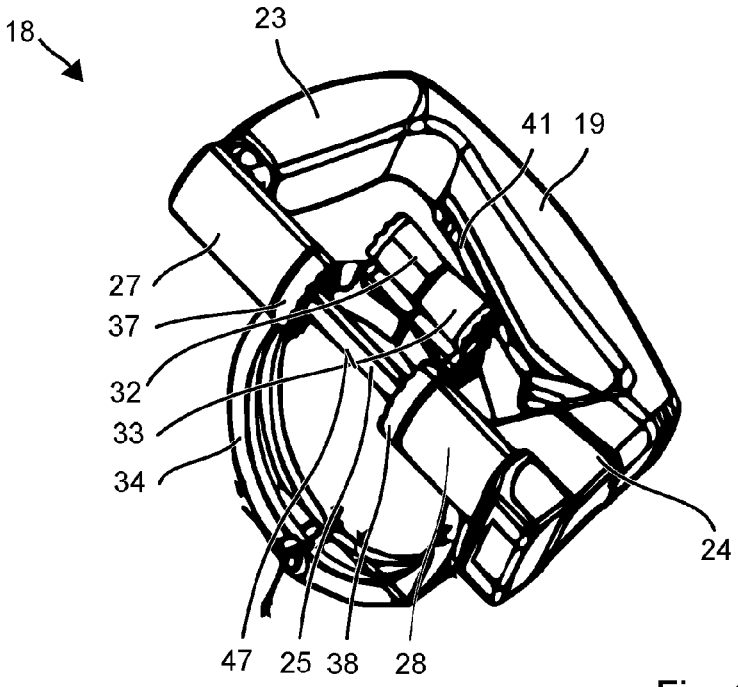
FIG. 4: the side handle with the clamp removed.
Figure 5:
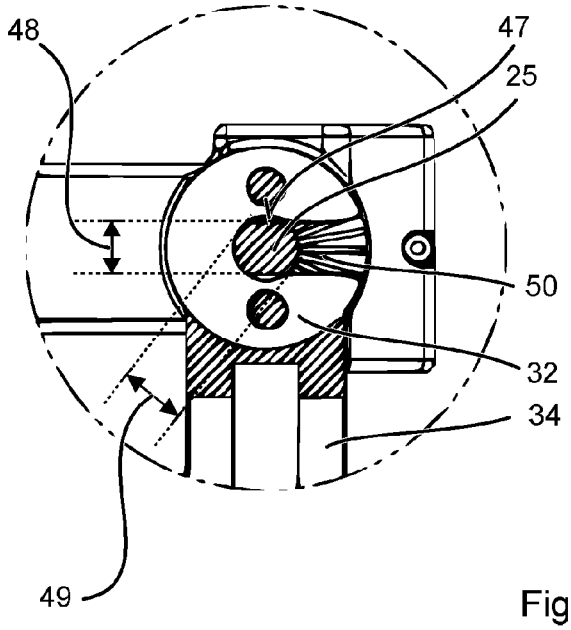
FIG. 5: a partial cross section of the side handle.

A left-hand sleeve 32 and a right-hand sleeve 33 are placed on the tie rod 25 between the two pillow block bearings 27, 28. Each one of the sleeves 32, 33 is joined to a clip 34. The two clips 34 are movably joined to each other via a joint 35 and together they form a ring-shaped clamp 36. The circumference of the clamp 36 can be varied by means of the distance between the two sleeves 32, 33. In the embodiment given by way of an example, the clamp 36 on the sleeves 32, 33 can be removed from the tie rod 25 (FIG. 4) and then opened up. The user can place the opened-up clamp 36, for example, around the power tool housing 17 near the tool socket 2 and can then shut it again. The clamp 36 can also be made in the form of a flexible strip rather than in the form of clips 34. The sleeves 32, 33, which are configured separately from the pillow block bearings 27, 28 can be connected to the latter, for instance, when there is no need for a removable clamp 36.

The left-hand sleeve 32 is in contact with the left-hand pillow block bearing 27, while the right-hand sleeve 33 is in contact with the right-hand pillow block bearing 28. The pillow block bearings 27, 28 can be provided with toothing 37, 38 pairwise on their end faces. The angular orientation of the clamp 36 relative to the grip element 19 with respect to the axis 26 can thus be provided with latching positions.

A compression spring, for instance, a helical spring 39, is arranged inside the right-hand pillow block bearing 28 parallel, that is to say, coaxially to the tie rod 25. A first (left-hand) end of the helical spring 39 is supported on a support surface 40 formed by the right-hand pillow block bearing 28 or else it is fastened in some other manner to the right-hand pillow block bearing 28. The left-hand end of the helical spring 39 is thus unmovable. The second (right-hand) end is in contact with the disk 31 of the tie rod 25. The right-hand end can move, for instance, when the tie rod 25 is moved in the pulling direction 29. Considering the right-hand pillow block bearing 28 as being stationary, the effective direction 29 of the helical spring 39 coincides with the pulling direction 29.

While under constant pre-tensioning, the helical spring 39 is inserted between the right-hand pillow block bearing 28 and the disk 31 of the tie rod 25. Consequently, the anchor 30 is constantly in contact with the left-hand pillow block bearing 27 and, under the effect of the helical spring 39, pulls it in the pulling direction 29 towards the right-hand pillow block bearing 28. The two sleeves 32, 33 are pushed by the left-hand pillow block bearing 27 in the effective direction 29 of the helical spring 39 against the right-hand pillow block bearing 28. The circumference of the clamp 36 is shortened and, consequently, the clamp 36 is clamped onto the handheld power tool 1.

The side handle 18 given by way of an example can be released by means of a toggle. The toggle has a lever grip 41 which the user can grasp and pull towards the grip element 19. The lever grip 41 and the grip element 19 are approximately parallel to each other. Preferably, the user can grasp around the grip element 19 without having to grasp the lever grip 41 at the same time. The distance from the lever grip 41 to the grip element 19 in the holding direction 21 is, for example, within the range from 3 cm to 5 cm. The toggle has a first lever arm 42 and a second lever arm 43 which are joined by a toggle linkage mechanism 44. The first lever arm 42 is placed against the right-hand leg 24 by means of a pivot joint and the second lever arm 43 is likewise placed against the right-hand leg 24 by means of pivot joint 45. The first lever arm 42 is rigidly connected to the lever grip 41. The second lever arm 43 is connected to the tie rod 25 by means of a journal 46.

The second lever arm 43 is deflected opposite to the effective direction 29 by the helical spring 39 when the user pulls the lever grip 41 towards the grip element 19. The tie rod 25 is shifted opposite to the pulling direction/effective direction 29 by means of the second lever arm 43. The anchor 30 is released from the left-hand pillow block bearing 27. The force flow onto the sleeves 32, 33 is interrupted. The sleeves 32, 33 can move away from each other on the axis 26 in order to reduce the tension of the clamp 36 by widening it.

The tie rod 25 is shifted against the effective direction 29 of the helical spring 39. The disk 31 of the tie rod 25 moves towards the support surface 40. The movable end of the helical spring 39 approaches the unmovable end, as a result of which the tension of the helical spring 39 rises beyond the pre-tension.

The toggle has proven to be particularly well-suited to bring about the requisite force to compress the helical spring 39. Other known lever mechanisms having a high transmission ratio are likewise suitable. The pre-tension that has to be overcome is, for example, within the range from 100 newton to 2000 newton. The regulating distance of the toggle, which is short owing to the high transmission ratio, is sufficient, especially in the case of a removable clamp 36.

The lever grip 41 is preferably kept under pre-tension in its normal position. The pre-tension is exerted by the helical spring 39. The lever grip 41 automatically goes to its normal position and does not wobble during the chiseling operation of the handheld power tool 1.

FIG. 8 shows a cross section through a sleeve 32 provided by way of an example, perpendicular to the axis 26. The tie rod 25 has one or two opposite flattened sides 47, preferably in the area of the sleeve 32. The radial dimension 48 of the tie rod 25 perpendicular to the sides 47 is smaller than in other angular directions. The other sides are, for instance, cylindrical.

The sleeve 32 has a cylindrical cavity whose inner diameter 49 matches the diameter of the tie rod 25. The sleeve 32 can be freely turned around the tie rod 25. The sleeve 32 is also slit along the axis 26. One dimension of the slot 50 parallel to the axis 26 matches the smallest radial dimension 48 of the tie rod 25. The dimension 48 is thus smaller than the inner diameter of the cylindrical cavity. The clamp 36 can only be pulled off the tie rod 25 if the flattened sides 47 have been oriented parallel to the slot 50. In this context, the clamp 34 is preferably angled by 90° relative to the grip element 19.

Figure 6:
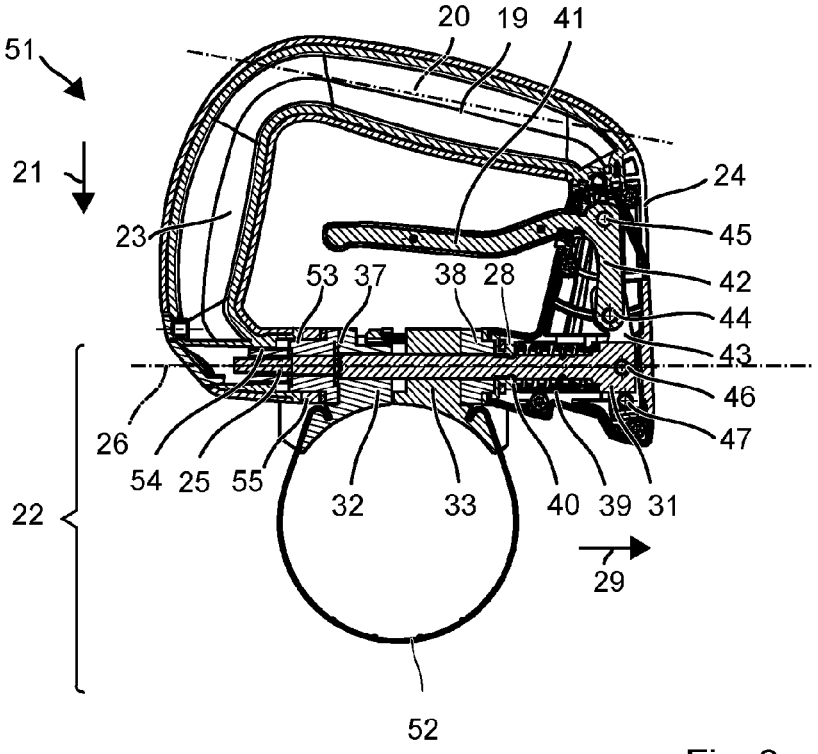
FIG. 6: a side handle in the normal position.
Figure 7:
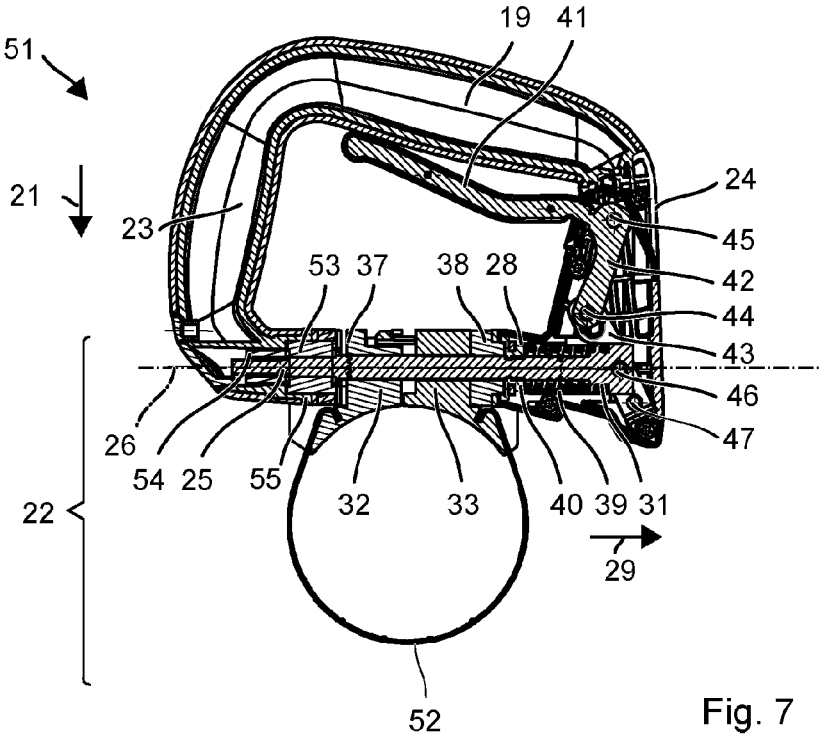
FIG. 7: the side handle in the release position.

FIGS. 6 and 7 show another configuration of the side handle 51 in the normal position and in the release position, respectively, so that it can be removed from or attached to the handheld power tool 1. Most of the elements in this embodiment correspond to those of the side handle 18 of FIGS. 2 and 3, so that a complete repetition of all of the features will be dispensed with and reference is hereby made to the preceding description.

By way of an example, the side 51 has a flexible metal strip 52, although two rigid clips 34 can also be employed instead of such a strip. The metal strip 52 is suspended on two sleeves 32, 33 that can be moved with respect to each other. The two sleeves 32, 33 are slipped onto a tie rod 25 between a first (left-hand) pillow block bearing 53 and a second (right-hand) pillow block bearing 28. The tie rod 25 is pre-tensioned by the spring 39 in the direction 29. The spring 39 is supported on the right-hand pillow block bearing 28 that is unmovably joined to the grip element 19. The left-hand pillow block bearing 53 is movable along the tie rod 25 relative to the grip element 19. The force-loaded tie rod 25 presses with an anchor 54 onto the left-hand pillow block bearing 53, thereby moving it in the direction 29 onto the sleeves 32, 33 in order to clamp on the metal strip 52 with these sleeves. The grip element 19 does not have to become deformed in this process. The left-hand pillow block bearing 53 can be employed in a guide 55 connected to the grip element 19.

What is claimed is:

1. A side handle for a handheld power tool, the side handle comprising:

a grip element graspable by a user with one hand;

a ring-shaped clamp, the clamp, for purposes of clamping the side handle onto the handheld power tool, having two ends, the two ends being joinable;

a pre-tensioned spring pressing the joinable ends against a stop to join the ends under a force acting in an effective direction;

a release mechanism held in a normal position by the force of the pre-tensioned spring, the release mechanism deflectable into a release position against the force of the pre-tensioned spring to cancel the force pressing the joinable ends against the stop, wherein a tension of the pre-tensioned spring in the release position of the release mechanism is higher than the pre-tension of the pre-tensioned spring in a normal position of the release mechanism, the release mechanism including a toggle; and a tie rod movable parallel to the effective direction relative to the stop and to the ends of the clamp, wherein an arm of the toggle is coupled to the tie rod.

2. A side handle for a handheld power tool, the side handle comprising:

a grip element graspable by a user with one hand;

a ring-shaped clamp, the clamp, for purposes of clamping the side handle onto the handheld power tool, having two ends, the two ends being joinable;

a pre-tensioned spring pressing the joinable ends against a stop to join the ends under a force acting in an effective direction;

a release mechanism held in a normal position by the force of the pre-tensioned spring, the release mechanism deflectable into a release position against the force of the pre-tensioned spring to cancel the force pressing the joinable ends against the stop, wherein a first end of the pre-tensioned spring is placed immovably in the side handle, while a second end of the pre-tensioned spring is movable, and the second end of the spring is coupled to the clamp and to the release mechanism.

3. The side handle as recited in claim 2 wherein the ends of the ring-shaped clamp rest on one side of the stop, and the unmovable first end of the pre-tensioned spring rests against a further side of the stop facing away from the one side.

4. A side handle for a handheld power tool, the side handle comprising:

a grip element graspable by a user with one hand;

a ring-shaped clamp, the clamp, for purposes of clamping the side handle onto the handheld power tool, having two ends, the two ends being joinable;

a pre-tensioned spring pressing the joinable ends against a stop to join the ends under a force acting in an effective direction;

a release mechanism held in a normal position by the force of the pre-tensioned spring, the release mechanism deflectable into a release position against the force of the pre-tensioned spring to cancel the force pressing the joinable ends against the stop; and a tie rod movable parallel to the effective direction relative to the stop and to the ends of the clamp, whereby, in the normal position, a first end section of the tie rod is non-positively coupled to the ends in the effective direction and the pre-tensioned spring is clamped between the stop and a second end section of the tie rod and exerts a force onto the tie rod in the effective direction.

5. The side handle as recited in claim 4 wherein, in the release position, the first end section of the tie rod is deflected against the force of the spring opposite to the effective direction and the non-positive coupling of the tie rod to the ends is cancelled.

6. The side handle as recited in claim 4 wherein the ends of the clamp are slipped onto the tie rod in the radial direction and are arranged along the effective direction between the first end section of the tie rod and the stop.

7. The side handle as recited in claim 6 wherein the tie rod has a non-circular cross section with a larger radial dimension and a smaller radial dimension, and the ends of the clamp have a cylindrical cavity with an inner diameter equal to the larger radial dimension and a slot radially opening up the cavity and having a width equal to the smaller radial dimension.

8. The side handle as recited in claim 4 wherein the release mechanism comprises a toggle, an arm of the toggle coupled to the tie rod.

* * * * *